US008062438B2

(12) United States Patent
Nakamura et al.

(10) Patent No.: US 8,062,438 B2
(45) Date of Patent: Nov. 22, 2011

(54) HOT-ROLLED THIN STEEL SHEET WITH EXCELLENT FORMABILITY AND EXCELLENT STRENGTH AND TOUGHNESS AFTER HEAT TREATMENT, AND METHOD FOR MANUFACTURING THE SAME

(75) Inventors: Nobuyuki Nakamura, Tokyo (JP); Kazuhiro Seto, Tokyo (JP)

(73) Assignee: JFE Steel Corporation (JP)

( * ) Notice: Subject to any disclaimer, the term of this patent is extended or adjusted under 35 U.S.C. 154(b) by 145 days.

(21) Appl. No.: 12/307,806

(22) PCT Filed: Jul. 6, 2007

(86) PCT No.: PCT/JP2007/063940

§ 371 (c)(1),
(2), (4) Date: Jan. 7, 2009

(87) PCT Pub. No.: WO2008/007753

PCT Pub. Date: Jan. 17, 2008

(65) Prior Publication Data

US 2009/0205756 A1 Aug. 20, 2009

(30) Foreign Application Priority Data

Jul. 10, 2006 (JP) ..... 2006-189475

(51) Int. Cl.
*C21D 8/02* (2006.01)
*C22C 38/00* (2006.01)

(52) U.S. Cl. ..... 148/602; 148/330

(58) Field of Classification Search ..... 148/330, 148/602

See application file for complete search history.

(56) References Cited

U.S. PATENT DOCUMENTS

| | | | | |
|---|---|---|---|---|
| 2002/0036035 | A1 | 3/2002 | Kashima et al. | |
| 2004/0035500 | A1 * | 2/2004 | Ikeda et al. | 148/320 |
| 2004/0187982 | A1 * | 9/2004 | Nakata et al. | 148/653 |

FOREIGN PATENT DOCUMENTS

| | | | |
|---|---|---|---|
| EP | 1 143 022 | | 10/2001 |
| EP | 1 154 028 | | 11/2001 |
| EP | 1 176 217 | A2 | 1/2002 |
| JP | 2768807 | | 5/1991 |
| JP | 10 140249 | | 5/1998 |
| JP | 2002-105595 | A | 4/2002 |
| JP | 2002 294339 | | 10/2002 |
| JP | 2002-309344 | A | 10/2002 |
| JP | 2002-309345 | A | 10/2002 |
| JP | 2004 107756 | | 4/2004 |
| JP | 2005-60796 | A | 3/2005 |
| WO | 01/66813 | | 9/2001 |

OTHER PUBLICATIONS

ASM Handbooks Onlline. Mechanical Properties of Carbon and Alloy Steels. "Effects of alloying elements". 2002.*

* cited by examiner

*Primary Examiner* — Jessica L Ward
*Assistant Examiner* — Alexander Polyansky
(74) *Attorney, Agent, or Firm* — DLA Piper LLP (US)

(57) ABSTRACT

Provided is a hot-rolled thin steel sheet having a thickness of less than 6 mm and having high strength showing a tensile strength of 440 MPa or more, excellent formability, and excellent strength and toughness after heat treatment and a method of manufacturing the same. A steel base material containing 0.10 to 0.20% of C, and Si, Mn, Al, P, S, and N adjusted to suitable amount ranges, and 0.01 to 0.15% of Ti and 0.0005 to 0.0050% of B is hot rolled so as to have a finishing temperature of finish rolling of 820 to 880° C.; after the completion of the rolling, the hot-rolled thin steel sheet is cooled to a surface temperature range of 550 to 650° C. at a surface cooling rate of 15 to 50° C./s; and the hot-rolled thin steel sheet is coiled at the temperature range.

1 Claim, No Drawings

HOT-ROLLED THIN STEEL SHEET WITH EXCELLENT FORMABILITY AND EXCELLENT STRENGTH AND TOUGHNESS AFTER HEAT TREATMENT, AND METHOD FOR MANUFACTURING THE SAME

RELATED APPLICATIONS

This is a §371 of International Application No. PCT/JP2007/063940, with an international filing date of Jul. 6, 2007 (WO 2008/007753 A1, published Jan. 17, 2008), which is based on Japanese Patent Application No. 2006-189475, filed Jul. 10, 2006.

TECHNICAL FIELD

This disclosure relates to a hot-rolled thin steel sheet suitable as a material for automobiles and, more specifically, relates to a hot-rolled thin steel sheet, which is suitable as a material for, in particular, an air bag component, with excellent formability and excellent strength showing a tensile strength of 440 to 640 MPa and toughness after heat treatment carried out after forming, and relates to a method for manufacturing the steel sheet. The term "thin steel sheet" herein means a steel sheet having a thickness of less than 6 mm and preferably 1 mm or more.

BACKGROUND

Recently, from the viewpoint of conservation of the global environment, exhaust emission standards for vehicles have been regulated strictly, and a reduction in weight of automobile body is promoted for improving fuel consumption. Accordingly, automobile members are also strongly required to be reduced in weight. Among automobile members, components with complicated shapes, such as an air bag component, have a problem that a difficulty in forming is steeply increased by using a highly strengthened steel sheet (steel sheet) for reducing the weights of the components.

Because of the problem, the steel sheet used as a material of the air bag component has a tensile strength of about 540 MPa even in the highest, unlike in other automobile components.

Recently, die quenching in which hardening is carried out while forming is in practical use as means for highly strengthening automobile members. However, since the air bag component has a very complicated shape, in general, the final shape cannot be formed by one-step forming and is, therefore, formed through a plurality of steps. Accordingly, it is difficult to apply the die quenching, which forms a final shape by one-step forming, to production of the air bag component. In addition, the air bag component is required to retain excellent low temperature toughness, but, the die quenching can not provide sufficient toughness by itself.

However, the automobile members are highly required to be reduced in weight, and, at the same time, automobile members such as an air bag component are desired to be highly strengthened. Accordingly, it has been recently tried to highly strengthen and also toughen the automobile members such as the air bag component by treating the members with heat by, for example, hardening after the formation of the shapes of the members. Therefore, a thin steel sheet that is used as a material for the automobile members such as the air bag component is required to have excellent strength and toughness after heat treatment, which is applied to the members after the formation of the shapes of the members.

To such requirements, for example, Japanese Unexamined Patent Application Publication No. 2002-309344 discloses a method for manufacturing a thin steel sheet of which the average grain size of BN as precipitate in steel being 0.1 μm or more and the prior austenite grain size after the hardening being 2 to 25 μm by hot rolling a steel containing 0.10 to 0.37% of C and appropriate amounts of Si, Mn, P, S, and Al and further B and N so as to satisfy a (14B/10.8N of 0.50 or more at a coiling temperature of 720° C. or less. It is said that the thin steel sheet produced by the method disclosed in Japanese Unexamined Patent Application Publication No. 2002-309344 can have excellent properties in hardening at low temperature for a short period of time after forming and excellent toughness after the hardening and also is low in variation of properties depending on hardening conditions.

Japanese Unexamined Patent Application Publication No. 2002-309345 discloses a method for manufacturing a thin steel sheet with impact toughness after hardening of which the average grain size of TiN as precipitate in steel being 0.06 to 0.30 μm and the prior austenite grain size after the hardening being 2 to 25 μm by hot rolling a steal containing 0.10 to 0.37% of C and appropriate amounts of Si, Mn, P, S, Al, and Ti and further B and N so as to satisfy an effective B amount of 0.0005% or more at a coiling temperature of 720° C. or less. It is said that the thin steel sheet manufactured by the method disclosed in Japanese Unexamined Patent Application Publication No. 2002-309345 can have excellent properties in hardening at low temperature for a short period of time after forming and excellent impact toughness after the hardening and also be low in variation of properties depending on hardening conditions.

Although the thin steel sheets manufactured by the methods disclosed in Japanese Unexamined Patent Application Publication Nos. 2002-309344 and 2002-309345 have excellent strength characteristics after heat treatment, the toughness after the heat treatment is insufficient and cannot satisfy the levels of recent requirement for toughness. Furthermore, the strength before the heat treatment is low, which causes a problem that the strength at the portion to which the heat treatment is not applied may be insufficient. In particular, this problem is significant when the portion without receiving heat treatment is required to have a strength of 490 MPa or more.

Accordingly, it could be helpful to solve the above-mentioned problems in conventional technology by providing a hot-rolled thin steel sheet having high strength and excellent formability, i.e., a tensile strength of 440 to 640 MPa and preferably 490 to 640 MPa and an elongation of 20% or more (gauge length GL: 50 mm) as the characteristics before forming/heat treatment that are required as an air bag component, and also having excellent strength and toughness after the heat treatment, and providing a method for manufacturing such a hot-rolled thin steel sheet.

In this description, a hot-rolled thin steel sheet with "excellent strength and toughness after heat treatment" means a hot-rolled thin steel sheet having high strength showing a tensile strength of 980 MPa or more and high ductility showing an elongation of 15% or more (GL: 50 mm) after usual water hardening and tempering treatment (water hardening at about 950° C. and tempering at from room temperature to 200° C.) and having high toughness showing a ductility-brittle fracture transition temperature vTrs of −100° C. or less in a Charpy impact test. Since the hot-rolled thin steel sheet is mainly used in functional or driving components of automobiles, the thickness thereof is less than 6 mm.

SUMMARY

We intensively investigated to find factors that affect strength and formability of a hot-rolled thin steel sheet with a thickness of less than 6 mm and factors that affect strength and toughness after heat treatment. As a result, we found that a hot-rolled thin steel sheet having excellent strength and toughness after heat treatment can be obtained by using a composition of low carbon steel containing 0.10 to 0.20% of C and appropriate amounts of Ti and B and forming a uniform bainitic ferrite single phase structure over the entire sheet thickness so as to give desired high strength and excellent formability and a uniform martensite after heat treatment.

We thus provide the following:

(1) a hot-rolled thin steel sheet having a thickness of less than 6 mm and having high strength and excellent formability and having excellent strength and toughness after heat treatment, wherein the hot-rolled thin steel sheet has a composition containing, as mass %, 0.10 to 0.20% of C, 0.01 to 1.0% of Si, 0.5 to 2.0% of Mn, 0.03% or less of P, 0.01% or less of S, 0.01 to 0.10% of Al, 0.005% or less of N, 0.01 to 0.15% of Ti, 0.0005 to 0.0050% of B, the balance of Fe, and unavoidable impurities; and a structure of a bainitic ferrite phase having an area fraction of 95% or more, and satisfies a tensile strength of 440 to 640 MPa; and (2) a method of manufacturing a hot-rolled thin steel sheet satisfying a tensile strength of 440 to 640 MPa, having a thickness of less than 6 mm, and having high strength and excellent formability and having excellent strength and toughness after heat treatment by hot-rolling a steel base material having a composition containing, as mass %, 0.10 to 0.20% of C. 0.01 to 1.0% of Si, 0.5 to 2.0% of Mn, 0.03% or less of P, 0.01% or less of S, 0.01 to 0.10% of Al, 0.005% or less of N, 0.01 to 0.15% of Ti, 0.0005 to 0.0050% of B, the balance of Fe, and unavoidable impurities at a finishing temperature of finish rolling of 820 to 880° C. to give a hot-rolled steel sheet with a thickness of less than 6 mm; cooling the hot-rolled steel sheet to the temperature range of the surface of 550 to 650° C. at a surface cooling rate of 15 to 50° C. per second; and coiling the hot-rolled steel sheet at the temperature range.

The hot-rolled thin steel sheet can have a tensile strength of 440 to 640 MPa, preferably 490 to 640 MPa, and an elongation of 20% or more, and have desired high strength and excellent formability such as stretch flangeability, and can be formed into complicated shapes such as an air bag component. Furthermore, the hot-rolled thin steel sheet can have high strength showing a tensile strength of 980 MPa or more, high ductility showing an elongation of 15% or more, and high toughness showing a ductility-brittle fracture transition temperature vTrs of −100° C. or less in a Charpy impact test by heat treatment after forming. Consequently, products, such as an air bag component, having excellent strength and also ductility and toughness can be readily and stably manufactured. Thus, we can achieve remarkable industrial effects.

DETAILED DESCRIPTION

Since the hot-rolled thin steel sheet is mainly used for functional or driving components of automobiles, the thickness thereof is limited to less than 6 mm. If the thin steel sheet for functional or driving components of automobiles has a thickness of 6 mm or more, the size of the components become large, which makes it difficult to built-in to the shaft body. Accordingly, the thickness is limited to 6 mm. First, the reasons for limiting the composition of the hot-rolled thin steel sheet will be described. Hereinafter, mass % is simply represented by %.

C: 0.10 to 0.20%

Carbon is an element that forms carbides in steel and effectively functions for enhancing the strength of a steel sheet and also effectively functions for enhancing martensite transformation during hardening treatment to strengthen the structure with the martensite phase. A content of 0.10% or more is necessary. When the content of C is less than 0.10%, it is difficult to ensure desired steel sheet strength (tensile strength: 440 MPa or more) and is also difficult to ensure desired strength after heat treatment (tensile strength: 980 MPa or more). On the other hand, a content of higher than 0.20% leads to higher steel sheet strength and higher strength after heat treatment, resulting in decreases in formability and toughness and also a decrease in weldability. Consequently, the C content is limited to the range of 0.10 to 0.20%.

Si: 0.01 to 1.0%

Silicon is an element having an activity of effectively increasing the strength of steel by solid solution strengthening. To obtain the effect, a content of 0.01% or more is necessary. On the other hand, a content of higher than 1.0% leads to occurrence of asperity called red scale on the surface, resulting in a decrease in surface properties and also a decrease in endurance strength. Consequently, the Si content is limited to the range of 0.01 to 1.0% and is preferably 0.35% or less.

Mn: 0.5 to 2.0%

Manganese is an element for effectively increasing the strength of steel by solid solution strengthening and also increasing the strength of steel through an improvement in hardening properties. To obtain the effects, a content of 0.5% or more is necessary. On the other hand, a content of higher than 2.0% leads to significant segregation, resulting in decreases in uniformity of the steel sheet properties and the material qualities after heat treatment. Consequently, the Mn content is limited to the range of 0.5 to 2.0% and is preferably 1.0 to 2.0%.

P: 0.03% or Less

Phosphorus causes segregation to decrease the uniformity of the material qualities and also significantly decrease the toughness after heat treatment. Consequently, it is preferable to keep the P content as low as possible, but excessive decreasing escalates the material cost. However, an excessive content of higher than 0.03% leads to significant segregation. Consequently, the P content is limited to 0.03% or less and is preferably 0.02% or less.

S: 0.01% or Less

Sulfur presents as sulfides in steel and decreases ductility to reduce, for example, bending formability. Consequently, it is preferable to keep the S content as low as possible, but excessive decreasing escalates the material cost. However, a content of higher than 0.01% significantly decreases the toughness after heat treatment. Consequently, the S content is limited to 0.01% or less and is preferably 0.005% or less.

Al: 0.01 to 0.10%

Aluminum is an element functioning as a deoxidizer. Such an effect is significant when the content is 0.01% or more, but a content of higher than 0.1% decreases formability and also decreases hardening properties. Consequently, the Al content is limited to the range of 0.01 to 0.1% and is preferably 0.05% or less.

N: 0.005% or Less

Nitrogen forms nitrides such as TiN and AlN in steel to decrease formability and also forms BN when hardened to decrease the solid solution B amount that is effective for improving hardening properties. These adverse effects of N are acceptable when the N content is 0.005% or less. Consequently, the N content is limited to 0.005% or less.

Ti: 0.01 to 0.15%

Titanium is an element that effectively functions for forming a bainitic ferrite phase as the structure after hot-rolling and also effectively functions for forming a nitride in priority to a nitride of B to improve hardening properties by solid solution B. These effects are recognized when the content is 0.01% or more, but a content of higher than 0.15% increases resistance to deformation when hot rolled to extremely increase the rolling load, and also decreases toughness after heat treatment. Consequently, the Ti content is limited to the range of 0.01 to 0.15% and is preferably 0.03 to 0.1%.

B: 0.0005 to 0.0050%

Boron is an element having an activity suppressing generation of polygonal ferrite and pearlite when cooled after hot rolling and also effectively functions for improving hardening properties and toughness during heat treatment. These effects are significant when the content is 0.0005% or more. On the other hand, a content of higher than 0.0050% increases resistance to deformation when hot rolled to extremely increase the rolling load and also generates bainite and martensite after hot rolling to cause defects such as sheet cracks. Consequently, the B content is limited to the range of 0.0005 to 0.0050% and is preferably 0.001 to 0.003%.

The balance other than the above-mentioned components is composed of Fe and unavoidable impurities. As the unavoidable impurities, for example, 0.3% or less of Cr and 0.2% or less of Mo are acceptable.

The hot-rolled thin steel sheet has the above-mentioned composition and has a single phase structure of a bainitic ferrite phase over the entire thickness. In this description, the single phase structure denotes a structure of a bainitic ferrite phase having an area fraction of 95% or more. The bainitic ferrite phase may include needle-like ferrite and acicular ferrite. In addition, as phases other than the bainitic ferrite phase, the structure may include, for example, a polygonal ferrite phase, a pearlite phase, a bainite phase, and a martensite phase are acceptable when they are 5% or less as the area fraction.

A hot-rolled thin steel sheet having desired high strength showing a tensile strength of 440 MPa or more and high ductility showing an elongation of 20% or more (GL: 50 mm) can be obtained by forming a single phase structure of a bainitic ferrite phase over the entire thickness of the steel sheet. The hot-rolled thin steel sheet has excellent formability such as stretch flange-ability to be formed into complicated shapes such as an air bag component. When the area fraction of the bainitic ferrite phase is less than 95%, desired high strength and high ductility can not be simultaneously achieved. In addition, when the structure fraction of the bainitic ferrite phase is decreased to less than 95%, the uniformity of the structure is decreased, resulting in a decrease in formability such as stretch flangeability (also called burring).

Next, a preferable method for manufacturing the hot-rolled thin steel sheet will be described.

Steel having the above-mentioned composition is molten with a usual converter or a vacuum melting furnace and is preferably molded to a steel base material such as a slab by a usual casting process such as continuous casting or ingot casting-direct rolling. However, the method of manufacturing the steel base material is not limited to this, and any usual method of manufacturing a steel base material can be suitably used.

The steel base material of the above-described composition is hot rolled into a hot-rolled steel sheet with a thickness of less than 6 mm. The heating temperature for the hot rolling is not particularly limited as long as the finishing temperature of finish rolling in the hot rolling described below is ensured, and is preferably 1000 to 1300° C., which is usual heating temperature. A heating temperature of higher than 1300° C. coarsens crystal grains and readily decreases hot formability. On the other hand, a heating temperature of less than 1000° C. increases resistance to deformation to increase the load to rolling facilities, which readily leads to a problem of difficulty in rolling.

The hot rolling is carried out so that the finishing temperature of the finish rolling is 820 to 880° C.

By adjusting the finishing temperature of the finish rolling to 820° C. or more, ferrite transformation is suppressed in the sequential cooling step, and a single phase structure of a bainitic ferrite phase having an area fraction of 95% or more can be formed. If the finishing temperature of the finish rolling is lower than 820° C., the ferrite transformation is enhanced in the sequential cooling step, which leads to difficulty in forming a bainitic ferrite single phase structure. On the other hand, if the finishing temperature of the finish rolling is higher than 880° C., not only the ferrite transformation but also bainitic ferrite transformation are suppressed, which leads to difficulty in forming a bainitic ferrite single phase structure. As a result, a bainite phase and a martensite phase readily occur. The occurrence of the bainite phase or the martensite phase causes a higher strength of a steel sheet, which may cause cracks in the steel sheet when it is coiled or uncoiled. Consequently, the finishing temperature of the finish rolling is limited to the range of 820 to 880° C.

After the completion of the rolling, the hot-rolled thin steel sheet is cooled to the temperature range of the surface of 550 to 650° C. at a cooling rate of the steel sheet surface of 15 to 50° C./s.

To form a bainitic ferrite single phase structure over the thickness of the steel sheet, the cooling rate of the steel sheet surface after the completion of the rolling is controlled to 15° C./s or more. When the cooling rate of the surface is less than 15° C./s, in the composition of the hot-rolled thin steel sheet, a polygonal ferrite phase is readily precipitated at, for example, the center of the sheet thickness, even if the hot-rolled thin steel sheet has a thickness less than 6 mm. Consequently, it is difficult to form a bainitic ferrite single phase structure having uniformity in the sheet thickness direction. On the other hand, if the surface is rapidly cooled at a surface cooling rate of higher than 50° C./s, martensite is generated at the surface, and a bainitic ferrite single phase structure having uniformity in the sheet thickness direction cannot be formed. The cooling is preferably carried out with water, and the control of the cooling rate is preferably carried out by changing the amount of the water or the time of pouring the water. Accordingly, the cooling of the hot-rolled thin steel sheet after the completion of the rolling is controlled to a cooling rate of 15 to 50° C./s as the steel sheet surface temperature. The surface cooling rate is obtained by averaging the finishing temperature of finish rolling and the temperature of terminating the cooling, which are obtained by measuring surface temperatures.

The temperature of terminating the cooling is that when the surface temperature of a steel sheet is in the range of 550 to 650° C. When the temperature of terminating the cooling is less than 550° C. as the surface temperature, a bainite phase and a martensite phase are generated and a bainitic ferrite single phase structure cannot be formed. In addition, cracks occur in the hot-rolled thin steel sheet when coiled, or the strength becomes higher, resulting in a decrease in the formability of the steel sheet. On the other hand, when the temperature of terminating the cooling is higher than 650° C., a polygonal ferrite phase and a pearlite phase are generated and a bainitic ferrite single phase structure cannot be formed. In addition, the strength of the steel sheet becomes lower than desired strength. Accordingly, the temperature of terminating the cooling after the rolling is limited to the temperature range of 550 to 650° C.

After the termination of the cooling, the hot-rolled steel sheet is coiled at the temperature range. When the coiling temperature is less than 550° C., a bainite phase and a martensite phase are generated and a bainitic ferrite single phase structure cannot be formed. On the other hand, when the coiling temperature is higher than 650° C., a polygonal ferrite phase and a pearlite phase are generated and a bainitic ferrite single phase structure cannot be formed. Accordingly, the coiling temperature is limited to the temperature range of 550 to 650° C. as the surface temperature of the steel sheet.

Example

Steel base materials (steel slabs) having compositions shown in Table 1 were heated to heating temperatures shown in Table 2 and then hot-rolled under the finish rolling conditions shown in Table 2 to give hot-rolled thin steel sheets having thicknesses shown in Table 2. After the completion of the finish rolling, the hot-rolled thin steel sheets were subjected to cooling under conditions shown in Table 2 and coiled at coiling temperatures shown in Table 2.

The resulting hot-rolled thin steel sheets were subjected to structural observation, a tensile test, and a hole-expanding test for evaluating the strength, ductility, and formability (stretch flangeability). Separately, test sheets were taken from the resulting hot-rolled thin steel sheets and were pickled to remove scale on the steel sheet surfaces and then subjected to heat treatment (hardening-tempering treatment). The test sheets were subjected to structural observation, the tensile test, and an impact test for evaluating the strength, ductility, and toughness after the heat treatment. The heat treatment was carried out by hardening and tempering. The hardening was carried out by heating the test sheets at 950° C. for 3 minutes and then putting them in water with a temperature of 20° C. The tempering was carried out by heating the test sheets at 200° C. for 60 minutes and then air cooling them. After the cooling, test pieces were taken from the test sheets and were subjected to the following tests.

(1) Structural Observation

A test piece for structural observation was taken from each of the resulting hot-rolled thin steel sheets (or test sheets). The sheet thickness cross section parallel to the rolling direction of the test piece was polished and subjected to Nital etching. The microstructures at a position 0.1 mm from the surface, a position of one forth of the thickness, and a central position of the thickness were observed (field number: 10) with a scanning electron microscope (SEM) at a magnification of 3000, and images thereof were taken. The type of the structure was observed, and the structure fraction (area fraction) of each phase was measured using an image analysis system. The area fraction of the bainitic ferrite phase was determined as an average value of the measurement values of the 10 fields observed.

(2) Tensile Test

A JIS No. 5 test piece (GL: 50 mm) was taken from each of the resulting hot-rolled thin steel sheets (or test sheets) such that the tensile direction is in a direction perpendicular to the rolling direction and was subjected to a tensile test according to JIS Z 2241. The tensile characteristics (yield strength: YS, tensile strength: TS, elongation: El) were determined for evaluating strength and ductility.

(3) Hole-Expanding Test

A test piece (size: sheet thickness t×100×100 mm) for a hole-expanding test was taken from each of the resulting hot-rolled thin steel sheets. The hole-expanding test was carried out according to the Japan Iron and Steel Federation Standards, JFST1001. That is, a die-cut hole with a diameter of 10 mm ($d_o$) was formed in the center of the test piece for the hole-expanding test. The test piece for hole-expanding test was expanded with a conical punch (vertical angle: 60° C.), and the hole diameter (d) when cracks passing through the thickness were formed at the edge of the die-cut hole was measured. The hole expansion rate λ (%) was determined for evaluating formability (stretch flangeability). The hole expansion rate λ (%) was defined by the following expression:

$$\lambda(\%)=\{(d-d_0)/d_0\}\times 100.$$

(4) Impact Test

A V-notch test piece was taken from each of the test sheets such that the longitudinal direction of the test piece is in a direction perpendicular to the rolling direction and was subjected to a Charpy impact test according to JIS Z 2242, and the ductility-brittle fracture transition temperature vTrs (° C.) was measured for evaluating the toughness after heat treatment. A sample with a vTrs of −100° C. or less is shown by ○, and a sample with a vTrs of higher than −100° C. is shown by X.

Table 3 shows the results.

TABLE 1

| | Chemical component (%) | | | | | | | | |
|---|---|---|---|---|---|---|---|---|---|
| Steel No. | C | Si | Mn | P | S | Al | N | Ti | B |
| A | 0.10 | 0.03 | 1.35 | 0.015 | 0.004 | 0.038 | 0.0035 | 0.042 | 0.0018 |
| B | 0.12 | 0.15 | 0.83 | 0.008 | 0.003 | 0.042 | 0.0036 | 0.035 | 0.0022 |
| C | 0.15 | 0.03 | 1.38 | 0.018 | 0.003 | 0.047 | 0.0030 | 0.038 | 0.0030 |
| D | 0.15 | 1.2 | 0.71 | 0.011 | 0.003 | 0.033 | 0.0043 | 0.045 | 0.0014 |
| E | 0.15 | 0.03 | 0.25 | 0.024 | 0.004 | 0.044 | 0.0047 | 0.041 | 0.0013 |
| F | 0.15 | 0.03 | 2.34 | 0.013 | 0.005 | 0.046 | 0.0038 | 0.039 | 0.0016 |
| G | 0.14 | 0.03 | 0.84 | 0.045 | 0.003 | 0.039 | 0.0032 | 0.037 | 0.0015 |
| H | 0.15 | 0.05 | 0.83 | 0.015 | 0.012 | 0.041 | 0.0041 | 0.048 | 0.0019 |
| I | 0.16 | 0.03 | 0.81 | 0.012 | 0.003 | 0.043 | 0.0039 | 0.004 | 0.0021 |
| J | 0.15 | 0.04 | 0.89 | 0.013 | 0.003 | 0.046 | 0.0042 | 0.16 | 0.0014 |
| K | 0.16 | 0.03 | 0.76 | 0.012 | 0.004 | 0.039 | 0.0044 | 0.038 | 0.0003 |
| L | 0.15 | 0.03 | 0.82 | 0.011 | 0.002 | 0.044 | 0.0042 | 0.042 | 0.0075 |
| M | 0.16 | 0.70 | 1.24 | 0.015 | 0.003 | 0.047 | 0.0046 | 0.052 | 0.0018 |
| N | 0.18 | 0.03 | 0.75 | 0.016 | 0.002 | 0.038 | 0.0042 | 0.043 | 0.0016 |
| O | 0.20 | 0.01 | 0.88 | 0.018 | 0.004 | 0.045 | 0.0038 | 0.044 | 0.0040 |
| P | 0.23 | 0.02 | 0.95 | 0.012 | 0.003 | 0.044 | 0.0036 | 0.041 | 0.0019 |
| Q | 0.08 | 0.03 | 0.77 | 0.011 | 0.004 | 0.043 | 0.0042 | 0.042 | 0.0023 |

TABLE 2

| Thin Steel Sheet No. | Steel No. | Hot Rolling Condition: Heating Temperature (° C.) | Finishing temperature* of finish rolling (° C.) | Cooling rate* (° C./s) | Cooling-terminating tempeature* (° C.) | Coiling temperature* (° C.) | Thickness (mm) | Note |
|---|---|---|---|---|---|---|---|---|
| 1 | A | 1200 | 860 | 40 | 630 | 610 | 1.4 | Example of the |
| 2 | B | 1200 | 855 | 50 | 620 | 590 | 2.0 | Example of the |
| 3 | C | 1250 | 860 | 30 | 630 | 600 | 3.5 | Example of the |
| 4 | C | 1250 | 800 | 40 | 630 | 600 | 4.3 | Comparative Example |
| 5 | C | 1250 | 920 | 40 | 620 | 580 | 5.0 | Comparative Example |
| 6 | C | 1250 | 860 | 5 | 630 | 620 | 3.5 | Comparative Example |
| 7 | C | 1250 | 850 | 100 | 600 | 570 | 3.5 | Comparative Example |
| 8 | C | 1250 | 855 | 40 | 550 | 500 | 3.5 | Comparative Example |
| 9 | C | 1250 | 860 | 45 | 650 | 680 | 3.5 | Comparative Example |
| 10 | C | 1250 | 870 | 30 | 680 | 630 | 3.5 | Comparative Example |
| 11 | C | 1250 | 870 | 30 | 520 | 550 | 3.5 | Comparative Example |
| 12 | D | 1250 | 860 | 40 | 650 | 600 | 3.5 | Comparative Example |
| 13 | E | 1250 | 860 | 40 | 640 | 590 | 3.5 | Comparative Example |
| 14 | F | 1250 | 865 | 40 | 630 | 580 | 3.5 | Comparative Example |
| 15 | G | 1250 | 845 | 45 | 640 | 600 | 3.5 | Comparative Example |
| 16 | H | 1250 | 850 | 40 | 640 | 610 | 3.5 | Comparative Example |
| 17 | I | 1250 | 860 | 40 | 640 | 610 | 3.5 | Comparative Example |
| 18 | J | 1250 | 850 | 40 | 620 | 600 | 3.5 | Comparative Example |
| 19 | K | 1250 | 855 | 35 | 630 | 600 | 3.5 | Comparative Example |
| 20 | L | 1250 | 840 | 40 | 640 | 600 | 3.5 | Comparative Example |
| 21 | M | 1250 | 860 | 40 | 590 | 550 | 1.4 | Example of the |
| 22 | N | 1250 | 855 | 20 | 650 | 650 | 2.0 | Example of the |
| 23 | O | 1250 | 830 | 40 | 640 | 620 | 3.5 | Example of the |
| 24 | P | 1250 | 860 | 40 | 640 | 620 | 3.5 | Comparative Example |
| 25 | Q | 1200 | 850 | 45 | 630 | 600 | 3.5 | Comparative Example |

*at surface

TABLE 3

| Thin steel sheet No. | Steel No. | Structure: 0.1 mm from the surface: Type* | BF Area fraction (%) | ¼ thickness position: Type* | BF Area fraction (%) | ½ thickness position: Type* | BF Area fraction (%) |
|---|---|---|---|---|---|---|---|
| 1 | A | BF | 100 | BF | 100 | BF + F | 97 |
| 2 | B | BF | 100 | BF | 100 | BF + F | 98 |
| 3 | C | BF | 100 | BF | 100 | BF | 100 |
| 4 | C | BF + F | 85 | BF + F | 82 | BF + F | 80 |
| 5 | C | BF + M | 80 | BF + M | 85 | BF + M | 90 |
| 6 | C | BF + F | 90 | BF + F | 88 | BF + F | 85 |
| 7 | C | BF + M | 80 | BF + M | 85 | BF + M | 90 |
| 8 | C | BF + B + M | 60 | BF + B | 65 | BF + B | 70 |
| 9 | C | BF + F | 80 | BF + F | 75 | BF + F | 70 |
| 10 | C | BF + F | 79 | BF + F | 73 | BF + F | 70 |
| 11 | C | BF + B + M | 61 | BF + B | 64 | BF + B | 70 |
| 12 | D | BF | 100 | BF | 100 | BF | 100 |
| 13 | E | BF | 100 | BF | 100 | BF | 100 |
| 14 | F | BF + M | 93 | BF | 100 | BF | 100 |
| 15 | G | BF | 100 | BF | 100 | BF | 100 |
| 16 | H | BF | 100 | BF | 100 | BF | 100 |
| 17 | I | BF + F | 94 | BF + F | 92 | BF + F | 90 |
| 18 | J | BF + M | 82 | BF + M | 87 | BF + M | 90 |
| 19 | K | BF | 100 | BF | 100 | BF | 100 |
| 20 | L | BF + M | 94 | BF | 100 | BF | 100 |
| 21 | M | BF | 100 | BF | 100 | BF | 100 |
| 22 | N | BF | 100 | BF | 100 | BF | 100 |
| 23 | O | BF | 100 | BF | 100 | BF | 100 |
| 24 | P | BF + B | 88 | BF + B | 91 | BF + B | 95 |
| 25 | Q | BF | 100 | BF | 100 | BF | 100 |

TABLE 3-continued

| Thin steel sheet No. | Base material characteristics of hot-rolled thin steel sheet YS (MPa) | TS (MPa) | EI (%) | Formability Hole expansion rate λ (%) | Characteristics after heat treatment YS (MPa) | TS (MPa) | EI (%)v | Toughness Trs (° C.) | Note |
|---|---|---|---|---|---|---|---|---|---|
| 1 | 394 | 492 | 29 | 108 | 905 | 1008 | 20 | ○ | Example of the invention |
| 2 | 415 | 522 | 27 | 90 | 941 | 1042 | 19 | ○ | Example of the invention |
| 3 | 460 | 580 | 24 | 81 | 1010 | 1123 | 18 | ○ | Example of the invention |
| 4 | 418 | 525 | 17 | 65 | 1082 | 1100 | 12 | ○ | Comparative Example |
| 5 | 501 | 631 | 14 | 57 | 995 | 1105 | 11 | ○ | Comparative Example |
| 6 | 425 | 530 | 17 | 66 | 1000 | 1110 | 12 | ○ | Comparative Example |
| 7 | 504 | 634 | 14 | 58 | 992 | 1110 | 10 | ○ | Comparative Example |
| 8 | 556 | 690 | 13 | 55 | 995 | 1100 | 9 | ○ | Comparative Example |
| 9 | 342 | 490 | 18 | 65 | 1005 | 1115 | 11 | ○ | Comparative Example |
| 10 | 335 | 482 | 19 | 68 | 1008 | 1120 | 10 | ○ | Comparative Example |
| 11 | 560 | 695 | 13 | 52 | 1006 | 1118 | 10 | ○ | Comparative Example |
| 12 | 458 | 575 | 16 | 64 | 1010 | 1120 | 11 | ○ | Comparative Example |
| 13 | 400 | 503 | 18 | 70 | 775 | 970 | 12 | ○ | Comparative Example |
| 14 | 541 | 682 | 13 | 41 | 1005 | 1120 | 5 | X | Comparative Example |
| 15 | 544 | 678 | 13 | 35 | 1000 | 1108 | 9 | X | Comparative Example |
| 16 | 558 | 695 | 13 | 28 | 1005 | 1118 | 7 | X | Comparative Example |
| 17 | 416 | 523 | 17 | 68 | 850 | 949 | 12 | ○ | Comparative Example |
| 18 | 460 | 581 | 15 | 62 | 992 | 1100 | 10 | X | Comparative Example |
| 19 | 458 | 578 | 16 | 63 | 832 | 923 | 13 | X | Comparative Example |
| 20 | 522 | 648 | 14 | 45 | 995 | 1108 | 11 | ○ | Comparative Example |
| 21 | 470 | 591 | 24 | 78 | 1003 | 1118 | 17 | ○ | Example of the invention |
| 22 | 494 | 614 | 23 | 75 | 1025 | 1135 | 16 | ○ | Example of the invention |
| 23 | 522 | 638 | 22 | 70 | 1043 | 1162 | 15 | ○ | Example of the invention |
| 24 | 557 | 698 | 13 | 48 | 1106 | 1228 | 6 | X | Comparative Example |
| 25 | 330 | 430 | 21 | 112 | 861 | 960 | 16 | ○ | Comparative Example |

*F: ferrite (massive form), B: bainite, M: martensite, BF: bainitic ferrite

The steel sheets in Examples each have a structure that is uniform in the thickness direction and is a single phase structure of a bainitic ferrite phase having an area fraction of 95% or more. The steel sheets in Examples are each a hot-rolled steel sheet having excellent stretch flangeability and high strength and excellent formability, such as a tensile strength of 440 MPa or more, an elongation of 20% or more, and a hole expansion rate λ of 70% or more. Furthermore, the hot-rolled thin steel sheets can ensure high strength showing a tensile strength of 980 MPa or more, high ductility showing an elongation of 15% or more, and high toughness showing a vTrs of −100° C. or less by hardening and tempering treatment.

On the other hand, in Comparative Examples that are outside the scope of this disclosure, a single phase structure of a uniform bainitic ferrite phase cannot be formed, and desired values of either of the strength or the ductility or both the strength and the ductility cannot be ensured. One or more of the strength, ductility, and toughness after hardening/tempering treatment are lower than the above-mentioned desired values. Thus, the hot-rolled thin steel sheets are poor in any of the strength, ductility, and toughness after the hardening/tempering treatment.

The invention claimed is:

1. A hot-rolled thin steel sheet having a thickness of less than 6 mm and having high strength and excellent formability and having excellent strength and toughness after heat treatment, wherein the hot-rolled thin steel sheet has a composition containing, as mass %, C: 0.10 to 0.20%,
Si: 0.01 to 1.0%,
Mn: 0.5 to 2.0%,
P: 0.03% or less,
S: 0.01% or less,
Al: 0.01 to 0.10%,
N: 0.005% or less,
Ti: 0.01 to 0.15%,
B: 0.0005 to 0.0050%, the balance of Fe, and unavoidable impurities; and a structure of a bainitic ferrite single phase having an area fraction of 95% or more, and the hot-rolled thin steel sheet satisfies a tensile strength of 440 to 640 MPa.

* * * * *